US008657622B1

(12) United States Patent
Wang

(10) Patent No.: US 8,657,622 B1
(45) Date of Patent: Feb. 25, 2014

(54) ELECTRICAL CONNECTOR ASSEMBLY

(71) Applicant: Jun-Hui Wang, Shenzhen (CN)

(72) Inventor: Jun-Hui Wang, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 14 days.

(21) Appl. No.: 13/629,518

(22) Filed: Sep. 27, 2012

(30) Foreign Application Priority Data

Sep. 20, 2012 (CN) ..... 2012 1 0350131

(51) Int. Cl.
*H01R 13/73* (2006.01)

(52) U.S. Cl.
USPC ..... 439/553

(58) Field of Classification Search
USPC ..... 439/553, 555
See application file for complete search history.

(56) References Cited

U.S. PATENT DOCUMENTS

| | | | | | |
|---|---|---|---|---|---|
| 2,352,126 | A * | 6/1944 | Schmitt | 439/553 |
| 4,124,267 | A * | 11/1978 | Mines et al. | 439/553 |
| 5,730,522 | A * | 3/1998 | Wyke et al. | 362/432 |
| 6,083,041 | A * | 7/2000 | Kuo | 439/553 |
| 6,095,855 | A * | 8/2000 | Iwata et al. | 439/553 |
| 6,290,536 | B1 * | 9/2001 | Hwang et al. | 439/553 |
| 6,739,893 | B2 * | 5/2004 | Hallitschke et al. | 439/248 |
| 6,764,312 | B2 * | 7/2004 | Ushiro et al. | 439/33 |
| 7,578,699 | B2 * | 8/2009 | Yin | 439/553 |
| 8,535,091 | B2 * | 9/2013 | Fu et al. | 439/573 |
| 2003/0171029 | A1 * | 9/2003 | Yamada et al. | 439/553 |

* cited by examiner

*Primary Examiner* — James Harvey
(74) *Attorney, Agent, or Firm* — Altis Law Group, Inc.

(57) ABSTRACT

A connector assembly includes a connector and a fixing plate. The connector includes a block, a connector body formed on a front surface of the block, a protrusion extending from a top of the block. The fixing plate defines an opening through which the connector body extends, and a notch communicating with the opening for the protrusion extending through. A resilient piece slantingly extends toward a first end of the opening from a second end of the opening opposite to the first end. The connector pushes the resilient piece toward the fixing plate, and then the connector is slid along the opening toward the first end of the opening, to allow the protrusion to engage with a front surface of the fixing plate. The resilient piece is restored and abuts an end wall of the block.

4 Claims, 3 Drawing Sheets

ELECTRICAL CONNECTOR ASSEMBLY

BACKGROUND

1. Technical Field

The present disclosure relates to a connector assembly.

2. Description of Related Art

In an electronic device, some connectors, such as serial advanced technology attachment (SATA) connectors, are mounted to a sidewall of an enclosure of the electronic device with screws. However, the screws are small and difficult to handle, and the installation of the connector in the computer with screws is tedious.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
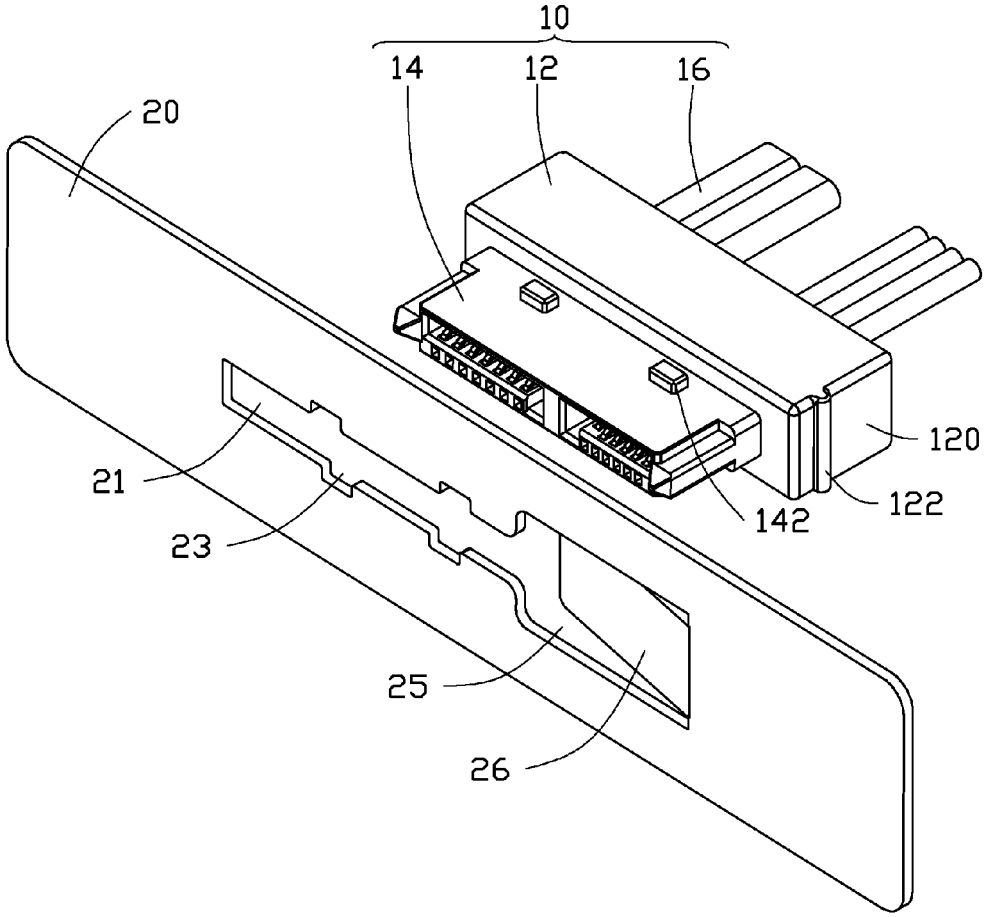
FIG. 1 is an exploded, isometric view of an exemplary embodiment of a connector assembly.

Referring to FIG. 1, an exemplary embodiment of a connector assembly is shown. The connector assembly includes a connector 10 and a fixing plate 20 for fixing the connector 10.

The connector 10 includes a block 12, a connector body 14 formed on a front surface of the block 12, and a plurality of cables 16 connected to the connector body 14 and extending from a rear surface of the block 12. Two spaced protrusions 142 extend up from a top of the connector body 14, and two similar spaced protrusions (not shown) extend down from a bottom of the connector body 14. The block 12 includes two opposite end walls 120. A bar 122 protrudes out from a front end of each end wall 120.

The fixing plate 20 is a part of a sidewall of an electronic device enclosure. A substantially rectangular opening 21 is defined in the fixing plate 20. Two notches 23 communicating with the top side of the opening 21 are defined in the fixing plate 20, two notches 23 communicating with the bottom side of the opening 21 are defined in the fixing plate 20, and a receiving hole 25 is defined in the fixing plate 20 communicating with a first end of the opening 21. A resilient piece 26 slantingly extends rearward and toward a second end of the opening 21 opposite to the first end from a sidewall bounding the receiving hole 25 away from the opening 21.

Figure 2:
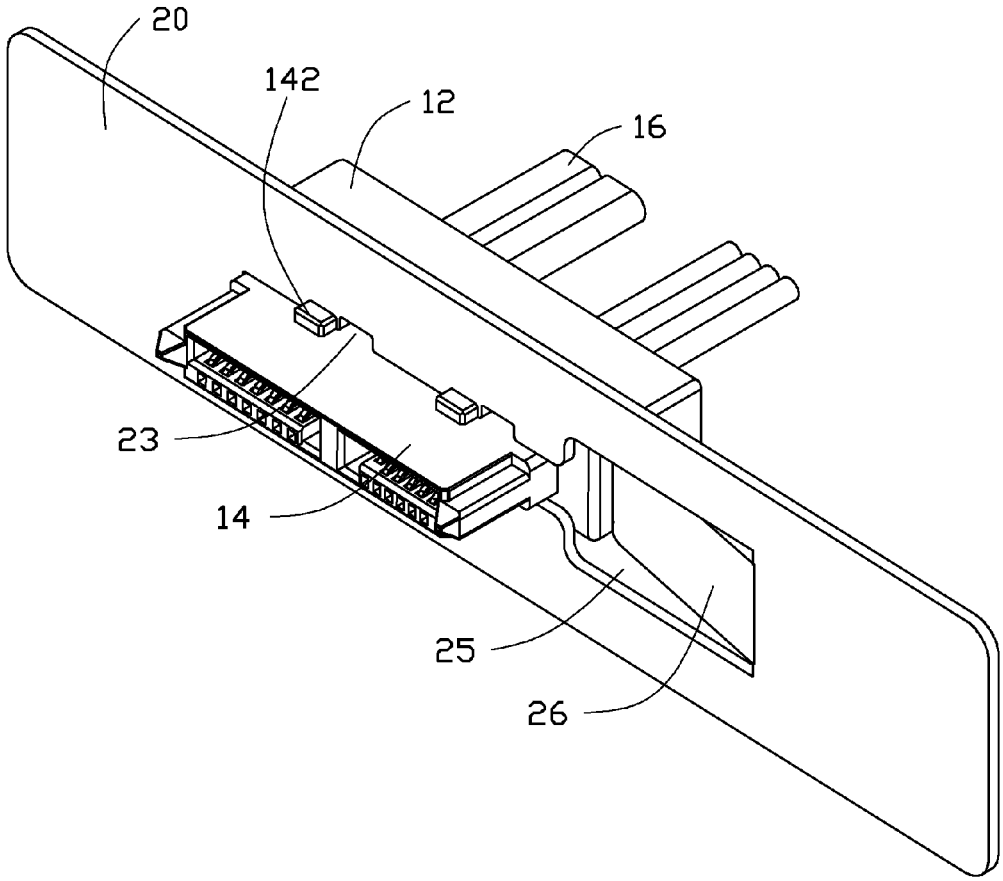
FIG. 2 is an assembled, isometric view of FIG. 1.
Figure 3:
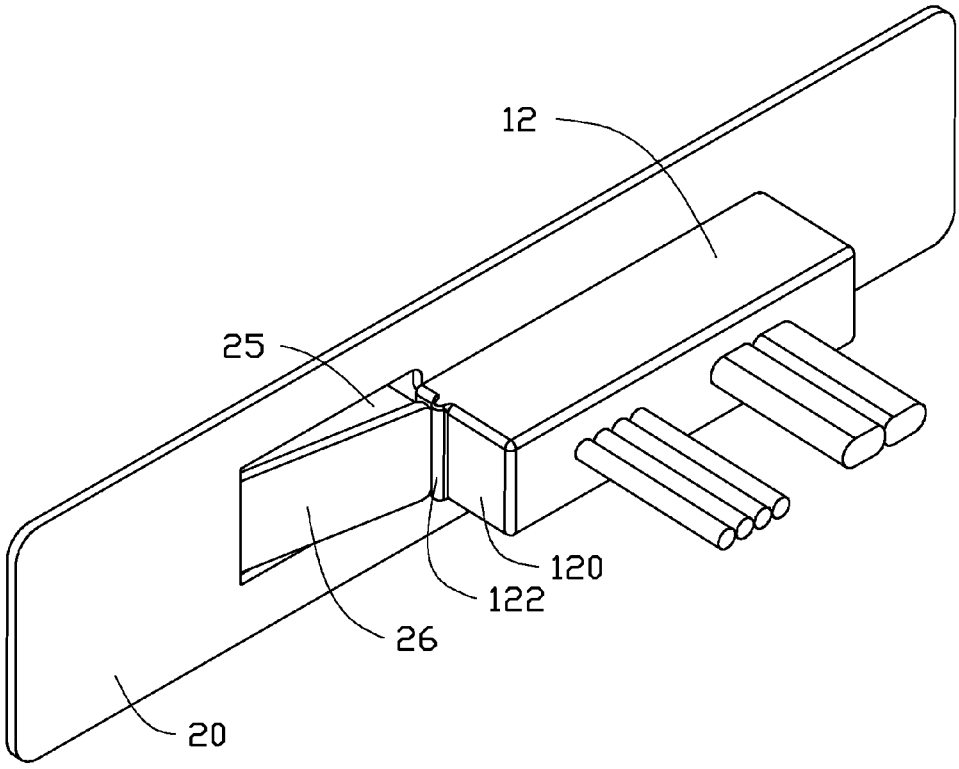
FIG. 3 is similar to FIG. 2, but viewed from another perspective.

Referring to FIGS. 2 and 3, the connector 10 is assembled in the manner of a linear bayonet mounting, by being placed behind the fixing plate 20, and each of the four protrusions 142 is aligned with one of the four notches 23. The connector body 14 extends through the opening 21. The protrusions 142 extend out through the notches 23. The resilient piece 26 is deformed forward by the block 12 and enters the receiving hole 25. The block 12 abuts a rear surface of the fixing plate 20. After the protrusions 142 have passed the notches 23, the connector 10 is longitudinally slid along the opening 21 toward the second end of the opening 21 (the locking direction), to allow the protrusions 142 to stagger with the corresponding notches 23 and to be blocked by a front surface of the fixing plate 20. The resilient piece 26 is then restored and abuts a corresponding sidewall 120 and is blocked by a front surface of the bar 122 facing the fixing plate 20. Thereby, the connector 10 is fixed to the fixing plate 20

To detach the connector 10 from the fixing plate 20, pressure from a user's fingernail, deforms the resilient piece 26 forward, to allow the resilient piece 26 to disengage from the block 12 and enter the receiving hole 25. The connector 10 may be slid toward the first end of the opening 21 (the unlocking direction) opposite to the locking direction, to allow the protrusions 142 to move towards the notches 23. When the protrusions 142 are once again aligned with the notches 23, the connector 10 can be removed away from the fixing plate 20.

In another embodiment, the receiving hole 25 may be omitted, and the resilient piece 26 slantingly extends toward the second end of the opening 21 from the first end of the opening 21.

In another embodiment, the protrusions formed at the bottom of the connector body 14 may be omitted.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A connector assembly, comprising:

a fixing plate defining an opening and a first notch communicating with the opening, a resilient piece slantingly extending from a first end of the opening toward a second end of the opening opposite to the first end;

a block comprising two opposite end walls, and a front surface connected between front ends of the end walls and abutting a rear surface of the fixing plate; and a connector body formed on the front surface of the block and capable of extending through the opening; a first protrusion extending from the connector body and capable of extending through the first notch;

wherein the resilient piece is deformed toward the fixing plate, the connector body is slid toward the second end of the opening to allow the first protrusion to stagger with the first notch and blocked by a front surface of the fixing plate opposite to the block, the resilient piece abuts one of the opposite end walls of the block.

2. The connector assembly of claim 1, wherein the fixing plate defines a receiving hole communicating with the first end of the opening to receive the resilient piece in response to the resilient piece is deformed.

3. The connector assembly of claim 1, wherein a bar protrudes from the end wall abutted by the resilient piece, the resilient piece is blocked by a front surface of the bar facing the fixing plate.

4. The connector assembly of claim 1, wherein the first protrusion extends up from a top of the connector body, the first notch communicates with a top side of the opening, the fixing plate further defines a second notch communicating with a bottom side of the opening opposite to the first notch, the connector body further comprises a second protrusion extending down from a bottom of the connector body to extend through the second notch.

* * * * *